US006745417B2

(12) United States Patent
Sumino

(10) Patent No.: US 6,745,417 B2
(45) Date of Patent: Jun. 8, 2004

(54) TOILET STOOL USABLE IN SITTING POSTURE

(76) Inventor: Hideo Sumino, 1-10, Minami-Tamondai 4-chome, Tarumi-ku, Kobe (JP)

( * ) Notice: Subject to any disclaimer, the term of this patent is extended or adjusted under 35 U.S.C. 154(b) by 0 days.

(21) Appl. No.: 10/255,681

(22) Filed: Sep. 27, 2002

(65) Prior Publication Data

US 2003/0074731 A1 Apr. 24, 2003

(30) Foreign Application Priority Data

Oct. 22, 2001 (JP) ..... 2001-323445
Oct. 22, 2001 (JP) ..... 2001-323600
Aug. 12, 2002 (JP) ..... 2002-234532

(51) Int. Cl.[7] ..... A47K 4/00

(52) U.S. Cl. ..... 4/662; 4/233; 4/229; 4/223; 4/222

(58) Field of Search ..... 4/662, 233, 229, 4/223, 222, 667, 237; 297/DIG. 10

(56) References Cited

U.S. PATENT DOCUMENTS 4,183,105 A * 1/1980 Womack ..... 4/300
4,216,553 A * 8/1980 Haberle ..... 4/300
4,242,764 A * 1/1981 Fukuda ..... 4/420.4
4,745,639 A * 5/1988 Wileman, III ..... 4/233
4,993,085 A * 2/1991 Gibbons ..... 4/667
5,022,098 A * 6/1991 Brower ..... 4/233
5,142,709 A * 9/1992 McGuire ..... 4/667
5,561,872 A * 10/1996 Phillips ..... 4/667
5,737,780 A * 4/1998 Okita et al. ..... 4/667
5,963,991 A * 10/1999 Agosti et al. ..... 4/233

FOREIGN PATENT DOCUMENTS

JP 60-88736 A 5/1985
JP 63-98752 U 6/1988
JP 2-194870 A 8/1990
JP 05-247989 A 9/1993
JP 5-84300 U 11/1993
JP 06-322805 A 11/1994
JP 07-189320 A 7/1995
JP 07-289477 A 11/1995
JP 10-075879 A 3/1998
JP 3053744 U 8/1998
JP 2001-017355 A 1/2001

* cited by examiner

*Primary Examiner*—Henry Bennett
*Assistant Examiner*—Azy Kokabi
(74) *Attorney, Agent, or Firm*—Birch, Stewart, Kolasch & Birch, LLP

(57) ABSTRACT

A toilet stool capable of using comfortably without cleaning is provided. The toilet stool comprises a main body 10, a seat 11, a cover 12, injection means 41 and 42, and a control means. The main body 10 can preserve stool temporarily therein. The seat 11 is formed on the main body 10. The cover 12 performs opening and closing operations by rotating about a horizontal axis with respect to the main body 10. The injection means 41 and 42 perform a cleaning operation by injecting pressure liquid for cleaning. The control means causes the injection means 41 and 42 to perform the cleaning operation on the condition that the cover is closed.

5 Claims, 17 Drawing Sheets

Fig. 3(b)

GENERAL REGISTERED DATA STORAGE PART

| TYPE OF USER | | SITTING | RELIEVING | FIRST LIMINAL VALUE | SECOND LIMINAL VALUE | THIRD LIMINAL VALUE |
|---|---|---|---|---|---|---|
| INFANT | | 300 | 300 | —— | —— | —— |
| ADULT | HEALTHY | 400 | 400 | —— | —— | —— |
| | ELDERLY | 650 | 400 | 20kg | 10kg | 0.5kg |

Fig. 3(c)

ADDITIONAL PERSONAL DATA STORAGE PART

| USER | ID No. | SITTING | RELIEVING | FIRST LIMINAL VALUE | SECOND LIMINAL VALUE |
|---|---|---|---|---|---|
| ELDERLY A | 001 | 400 | 380 | 20kg | 12kg |
| ELDERLY B | 002 | 650 | 400 | 20kg | 15kg |
| ELDERLY C | 003 | 700 | 499 | 20kg | 10kg |
| : | : | : | : | : | : |

10
11
13a
13b
14
15
Ls
Lo
L2

TOILET STOOL USABLE IN SITTING POSTURE

BACKGROUND OF THE INVENTION

1. Field of the Invention

This invention relates to a toilet stool used in a sitting posture, particular a toilet stool suitable for the elderly.

2. Description of the Prior Art

This kind of toilet stool is disclosed in Japan Unexamined Patent Publication No. 7-189320.

With the conventional toilet stool, water is previously sprayed to a part of inner surface of the toilet stool before relieving oneself. This prevents stool from adhering to the surface of the toilet stool.

Further, after relieving oneself, flush of large amount of water washes away stool as well as cleans the inner surface of the toilet stool.

Remaining stool after flushing the toilet, however, cannot be removed.

In particular, elderly persons are prone to make a toilet stool dirty in relieving oneself. Moreover, such elderly persons have no physical strength to clean the toilet.

Therefore, a primary object of the present invention is to provide a toilet stool that can be used comfortably without cleaning.

SUMMARY OF THE INVENTION

A toilet stool of the present invention comprises a main body, a seat, a cover, an injection means and a control means. The main body enables stool to be reserved therein temporarily. The seat is provided on the main body. The cover performs opening and closing operations by rotating about a horizontal axis with respect to the main body. The injection means perform a cleaning operation by injecting pressure liquid for cleaning. The control means causes the injection means to perform the cleaning operation on the condition that the cover is closed.

In cleaning the toilet stool, firstly, an opening of the toilet stool is closed by the cover. Secondly, when the cleaning operation is triggered, the liquid for cleaning is injected into the main body and the top surface of the seat, thereby cleaning the toilet stool.

According to the present invention, the cleaning operation is performed provided that the cover is closed with a locked condition. Therefore, there is no possibility that cleaning water or liquid will be splashed on the user, resulting in a water-soaked toilet room.

In a preferred embodiment of the present invention, the injection means is formed on the inner surface of the cover. According to this embodiment, as the injection means can be provided at a clean and high position, it is possible to clean the seat for sitting down.

In another preferred embodiment of the present invention, a first nozzle and a second nozzle are provided as the injection means. According to this embodiment, the first nozzle injects liquid to the inside of the main body, while the second nozzle injects liquid to the top surface of the seat, so that each part of the toilet stool can be cleaned for sure.

In another preferred embodiment of the present invention, it is controlled so that the injection of liquid from the second nozzle is finished following the finish of the injection of liquid from the first nozzle. According to this embodiment, after the relatively dirty main body has been cleaned, smudge spattered on other parts due to the cleaning of the main body can be removed by liquid from the second nozzle.

In another preferred embodiment of the present invention, the second nozzle is provided so as to rotate by the liquid pressure. According to this embodiment, the rotation of the second nozzle enables liquid to fly in many directions. Moreover, as it is no need to supply an driving force for rotating the second nozzle additionally, cost-reduction can be achieved.

In another preferred embodiment of the present invention, a decompression valve is connected to the second nozzle and liquid pressure is reduced so that discharge pressure of liquid injected from the second nozzle is smaller than that of liquid injected from the first nozzle. The second nozzle serves a function of washing away the dirt on the seat and does not require such a large pressure as the first nozzle requires. Also, as the discharge pressure of the second nozzle is smaller than that of the first nozzle, leak due to excessive pressure can be prevented.

In another preferred embodiment of the present invention, it is controlled so that liquid pressure reduced by the decompression valve is gradually increased during injection. In this embodiment, the decompressed liquid injected from the second nozzle cleans whole of the toilet stool. And then, by increasing the discharge pressure by degrees, the liquid injected from the nozzle hits against the seat and cleans the upper part of the toilet stool following the cleaning of the whole toilet stool. Thus, the seat to be kept cleaner can be intensively cleaned.

In another preferred embodiment of the present invention, a plurality of the second nozzles is provided so that one second nozzle cleans other second nozzles. In this embodiment, the second nozzles are always kept clean by cleaning each other.

In another preferred embodiment of the present invention, the seat is elevated or lowered depending on the type of users or users identified by identification means. In this embodiment, after identification of the type of users and so on, the seat can be stopped at the height on the basis of the type of users, etc. in elevating or lowering the seat and therefore the toilet stool becomes very convenient to use for each user.

In another preferred embodiment of the present invention, after the user sits down, the seat starts lowering and if it is determined that the user's sitting condition is stable, the seat continues to lower. On the other hand, if it is determined that the user's sitting condition is unstable, the seat lowers at a slower speed or stops lowering. In this embodiment, the seat is lowered at the speed according to users' muscular strength in their lower body.

DESCRIPTION OF THE PREFERRED EMBODIMENTS

Figure 1:
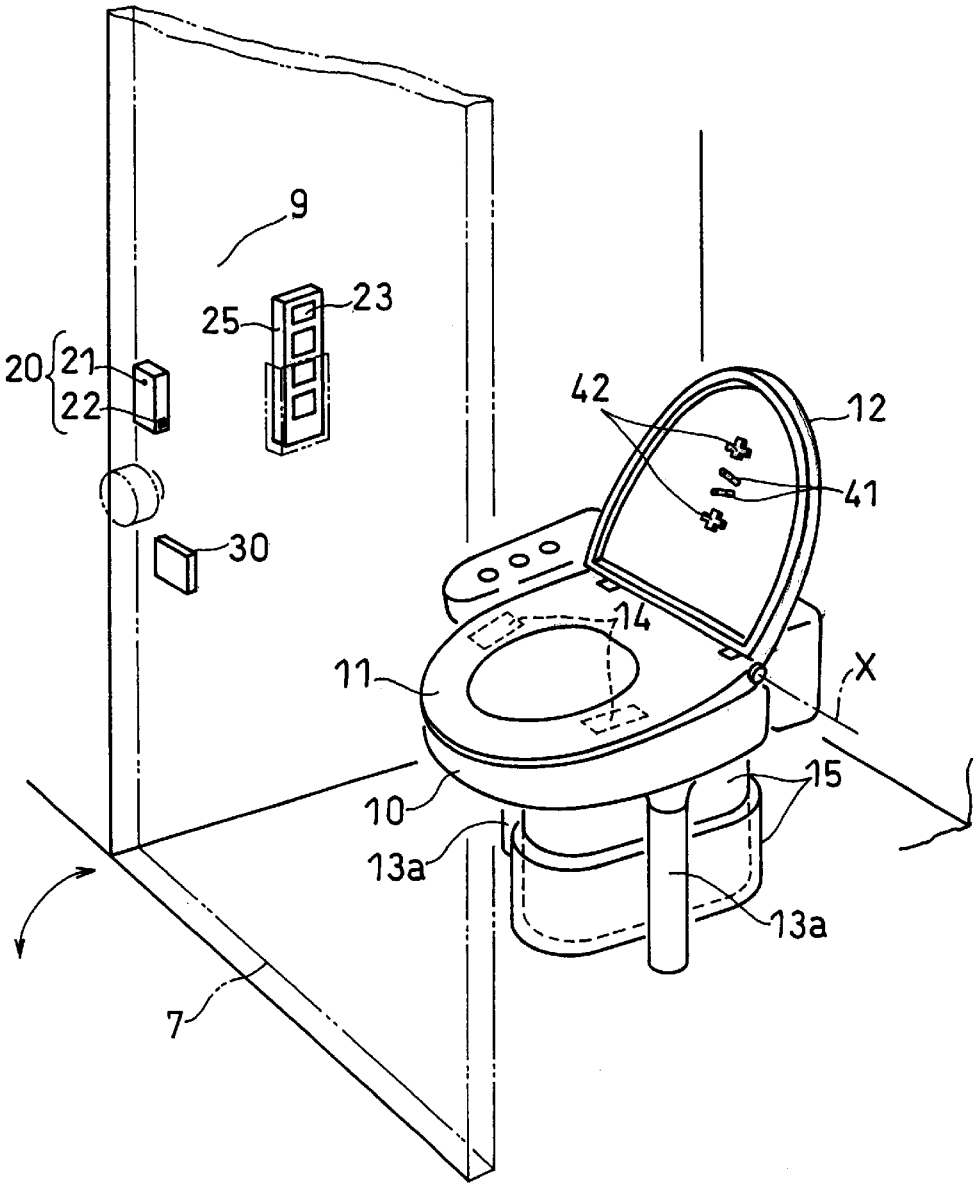
FIG. 1 is a schematic perspective view showing a Western-style toilet stool with elevating/lowering function and a toilet room according to an embodiment of the present invention.

Although the present invention will be understood more clearly in the description of the following preferred embodiments with reference to accompanying drawings, the embodiments and drawings are used for explanation and illustration of the present invention, not definition of the scope of it. The scope of the present invention, therefore, is to be determined solely by the following claims. In the accompanying drawings, components with identical reference numerals in plural drawings represent identical or equivalent ones.

Overall Structure

Figure 2A:
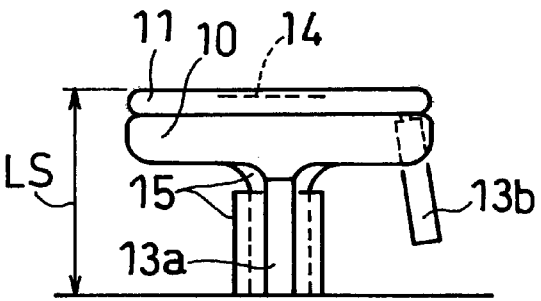
FIGS. 2(*a*) to 2(*c*) are side views of the Western-style toilet stool.
Figure 2B:
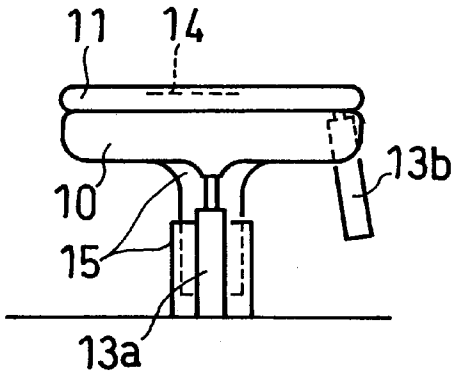
Figure 2C:
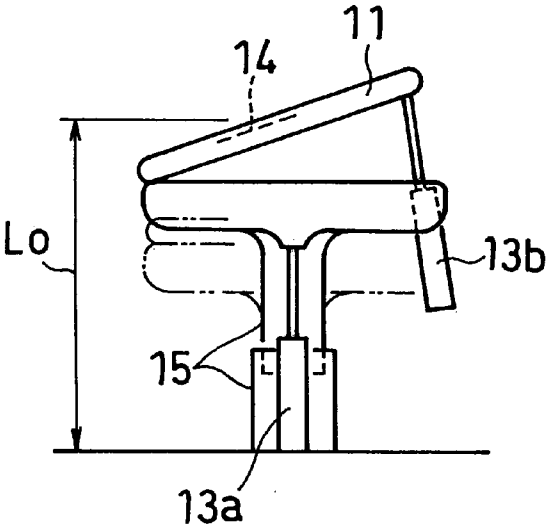

As shown in FIG. 1, an elevating means (an elevating/lowering means) 13*a* for carrying out a part of elevating function and a drainage part 15 are provided under a main body 10. The elevating means 13*a* that consists of, for example, an air cylinder device is used in a pair, each being attached to left and right end of the bottom part of the main body 10, respectively. As shown in FIGS. 2(*a*), 2(*b*) and 2(*c*), the Western-style toilet stool causes the main body 10 to elevate or lower by extension/contraction of the elevating means 13*a* so that the top surface of a seat 11 can be held at various height levels.

The drainage part 15 is elastically formed so as to drain away therefrom at any height level.

The seat 11 is mounted on the main body 10. The front part of the bottom surface of the seat 11 is fixed at the top surface of the main body 10 with a hinge (not shown). At rear end of the main body 10, an inclining means 13*b* that consists of, for example, an air cylinder device for carrying out a part of elevating function is provided. As shown in FIG. 2(*c*), the inclining means 13*b* pushes up the rear part of the bottom surface of the seat 11, thereby making the seat 11 inclined forward.

As described later, a cover 12 is structured so as to open or close automatically in using the toilet stool.

Equipment structure

This Western-style toilet stool can be used both at home and nursing facilities. Firstly, use at home will be described.

Figure 3:
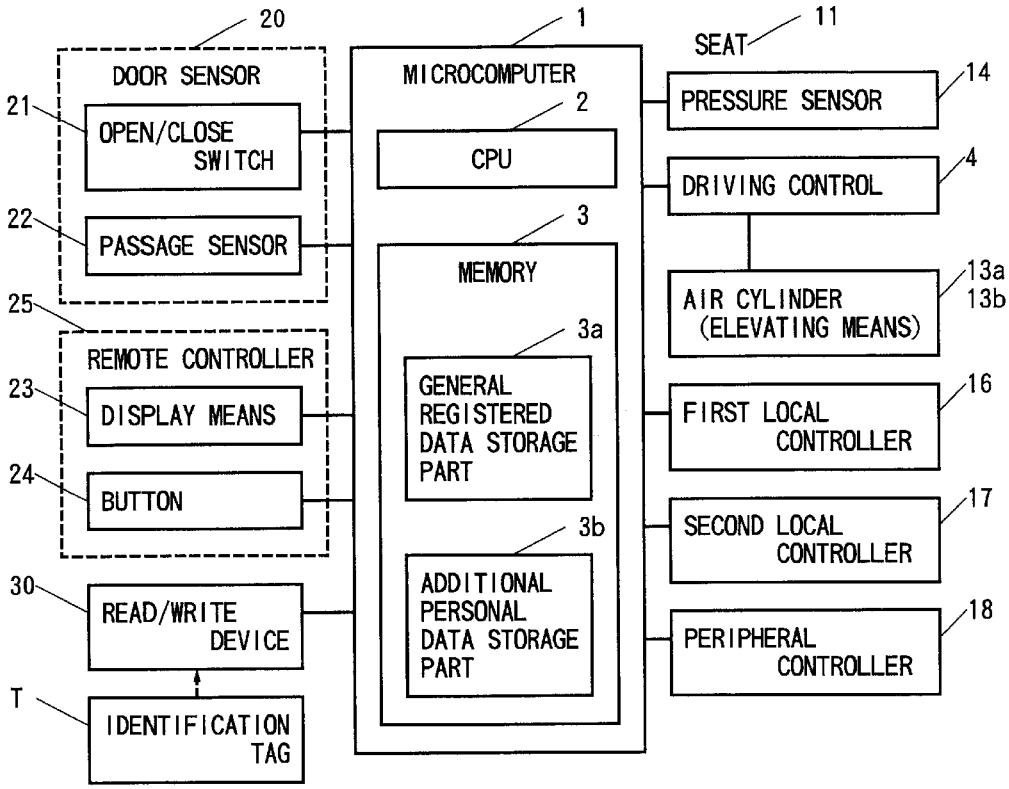
FIG. 3(*a*) is a schematic structural diagram of the Western-style toilet stool and FIG. 3(*b*) and FIG. 3(*c*) are tables showing contents of data storage parts.

As shown in FIG. 3(*a*), the Western-style toilet stool comprises a microcomputer (control means) 1 for performing various calculations and controls. The microcomputer 1 is connected to a door sensor 20, a remote controller 25, a pressure sensor 14 and a driving control means 4 through an interface not shown. The driving control means 4 controls the driving of the elevating means 13*a* and the inclining means 13*b* and is connected to them.

Figure 5A:
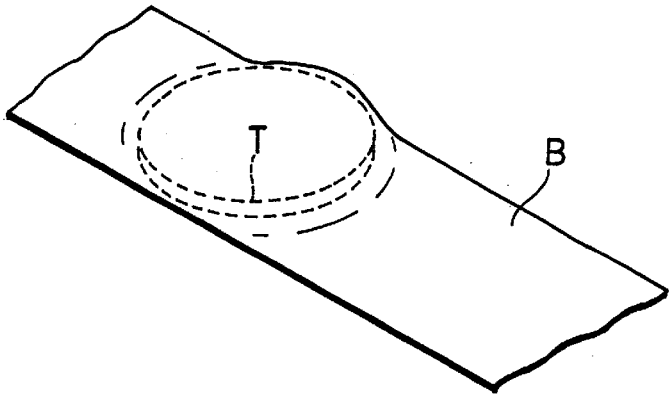
FIG. 5(*a*) is a perspective view of an identification tag, and FIG. 5(*b*) is a schematic structural diagram showing a read/write device and the identification tag.
Figure 5:
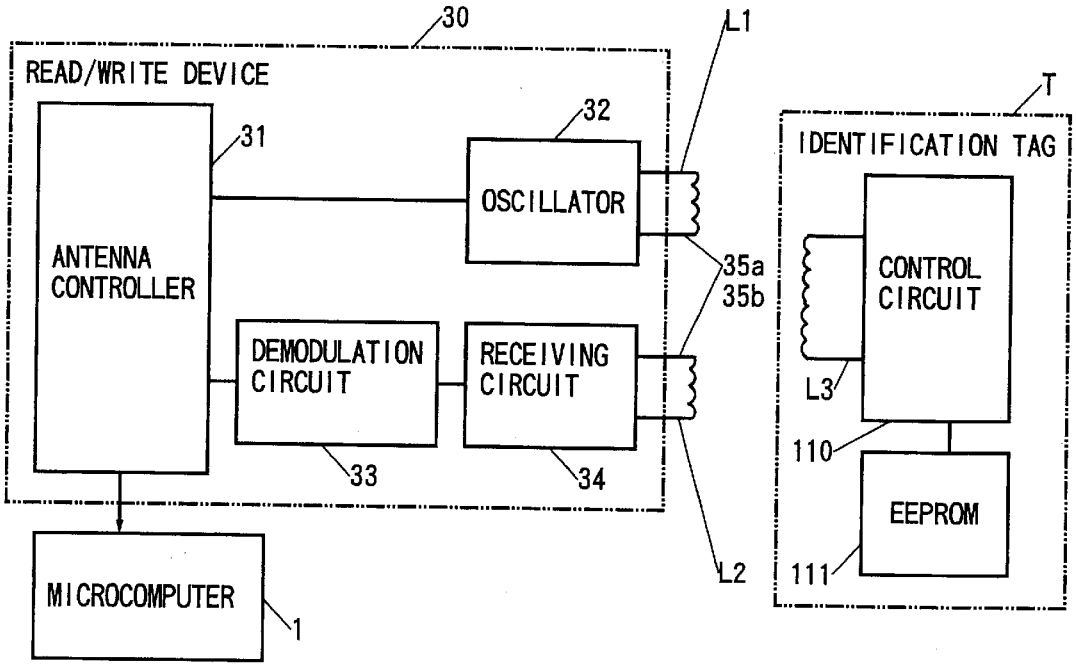

In the case of using the toilet stool in nursing facilities, a read/write device 30 for an identification tag T as shown in FIG. 5(*b*) is also connected to the microcomputer 1. The read/write device 30 is installed in the vicinity of a doorknob.

As shown in FIG. 3(*a*), the microcomputer 1 comprises a CPU 2 and a memory 3. A general registered data storage part (first storage part) 3*a* and an additional personal data storage part (second storage part) 3*b* are provided in the memory 3.

As shown in FIG. 3(*b*), registered data correlated with types of users consisting of infants, healthy adults and elderly persons by type are stored in the general registered data storage part 3*a*. The registered data are preset at the shipment of the Western-style toilet stools. The registered data consist of level information including seat height level when sitting down and seat height level relieving oneself; and a first liminal value, a second liminal value and a third liminal value described later.

Identification Means

As shown in FIG. 1, the door sensor 20 and the remote controller 25 are fixed at a wall 9 in the toilet room. The remote controller 25 may be a wireless portable device.

Door Sensor

The door sensor 20 comprises a door open/close switch 21 and a passage sensor 22. The open/close switch 21 is, for example, a touch switch. When a door 7 shown by chain double-dashed line is opened, an open signal is input to the microcomputer 1 while the door 7 is open.

The passage sensor 22 is, for example, an optical sensor. When a person taller than a prescribed height of infant (for example, 100 cm) passes, the passage sensor 22 inputs a person detection signal to the microcomputer 1.

In the case where the CPU 2 receives the open signal of the door 7 from the open/close switch 21 and then receives the person detection signal from the passage sensor 22, it determines that a person taller than the prescribed height to be detected by the passage sensor 22 (100 cm), that is, an adult other than infant has entered into the toilet room and performs given operations as described later. Otherwise, in the case where the CPU 2 receives the open signal of the door 7 from the open/close switch 2l and then receives no person detection signal within a prescribed period, it determines that an infant has entered the room. Therefore, the open/close switch 21 and the passage sensor 22 form a (first) identification means for identifying the type of user.

Remote Controller

Figure 4:
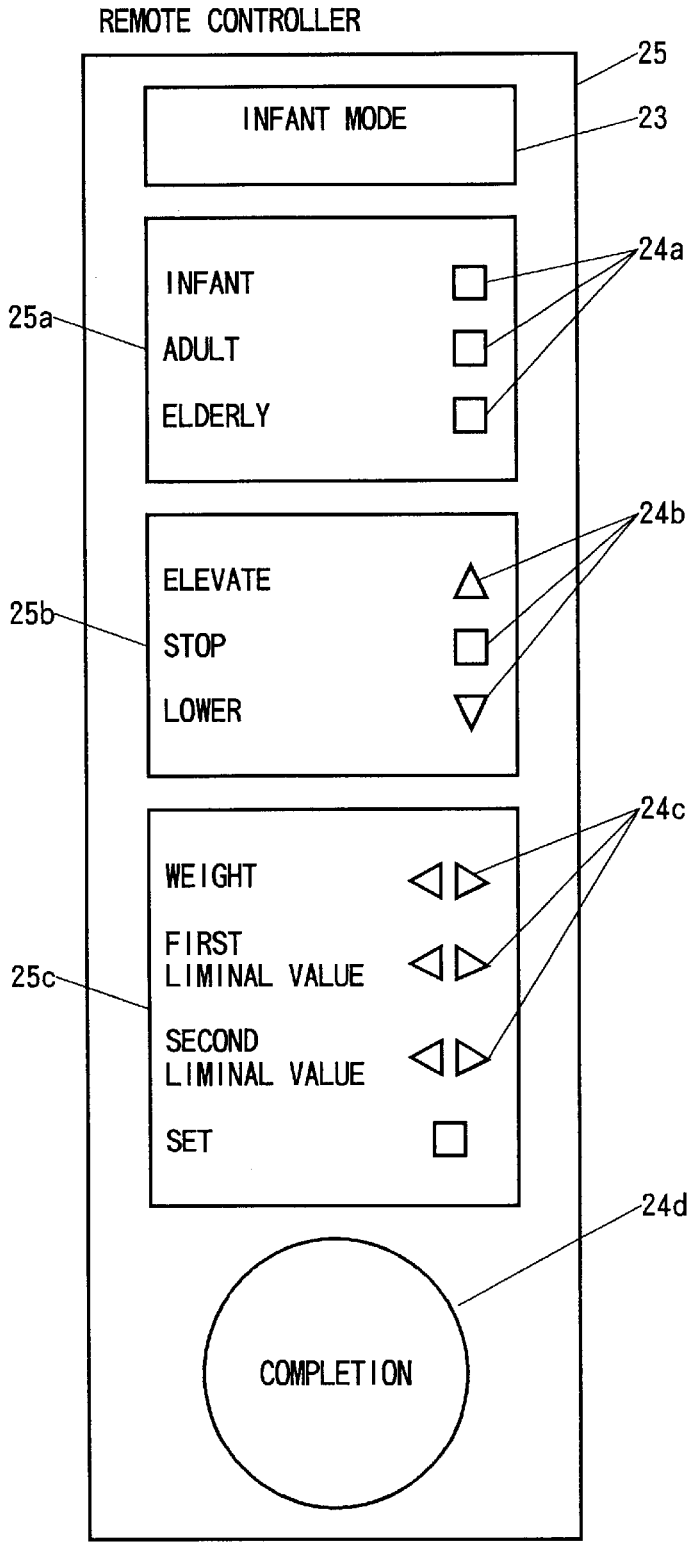
FIG. 4 is a front view of a remote controller.

As shown in FIG. 4, the remote controller 25 comprises a display means 23, input areas 25*a* to 25*c*, switch buttons 24*a* to 24*c* and a completion button 24*d* as described later. The display means 23 is, for example, a liquid crystal display for displaying various information output from the microcomputer 1.

The input areas consist of a type area 25*a*, a manual area 25*b* and a setting area 25*c* as described later.

The type area 25*a* is provided with a type button 24*a* corresponding to type of user. When the type button 24*a* is pushed, a type signal representing the type of user is transmitted to the microcomputer 1. When the CPU 2 receives the type signal, it reads registered data on the type of user corresponding to the type signal from the general registered data storage part 3*a*. Thus, the remote controller 25 having the type button 24*a* forms a (second) identification means for identifying a type of user by means of user's input.

Load Detection Means (Sitting Detection Means)

As shown by dashed line in FIG. 1, the seat 11 embeds the pressure sensor 14 therein. The pressure sensor 14 is, for example, a resistance-varying pressure sensor unit that decreases resistance value as the temperature rises. The pressure sensor 14 outputs a pressure signal in accordance with the pressure exerted thereon (i.e. load applied on the seat). Also, a pressure sensor unit made by A PLUS Corporation may be employed as the pressure sensor 14.

The CPU 2 shown in FIG. 3(*a*) calculates the load based on the pressure signal from the pressure sensor 14. The CPU 2 makes the following determination on the basis of the first and second liminal values stored in the general registered data storage part 3*a*.

A First Determination: Sitting Determination (Load>First Liminal Value)

Figures 9A, 9B, 9C, 9D, 9E, 9F:
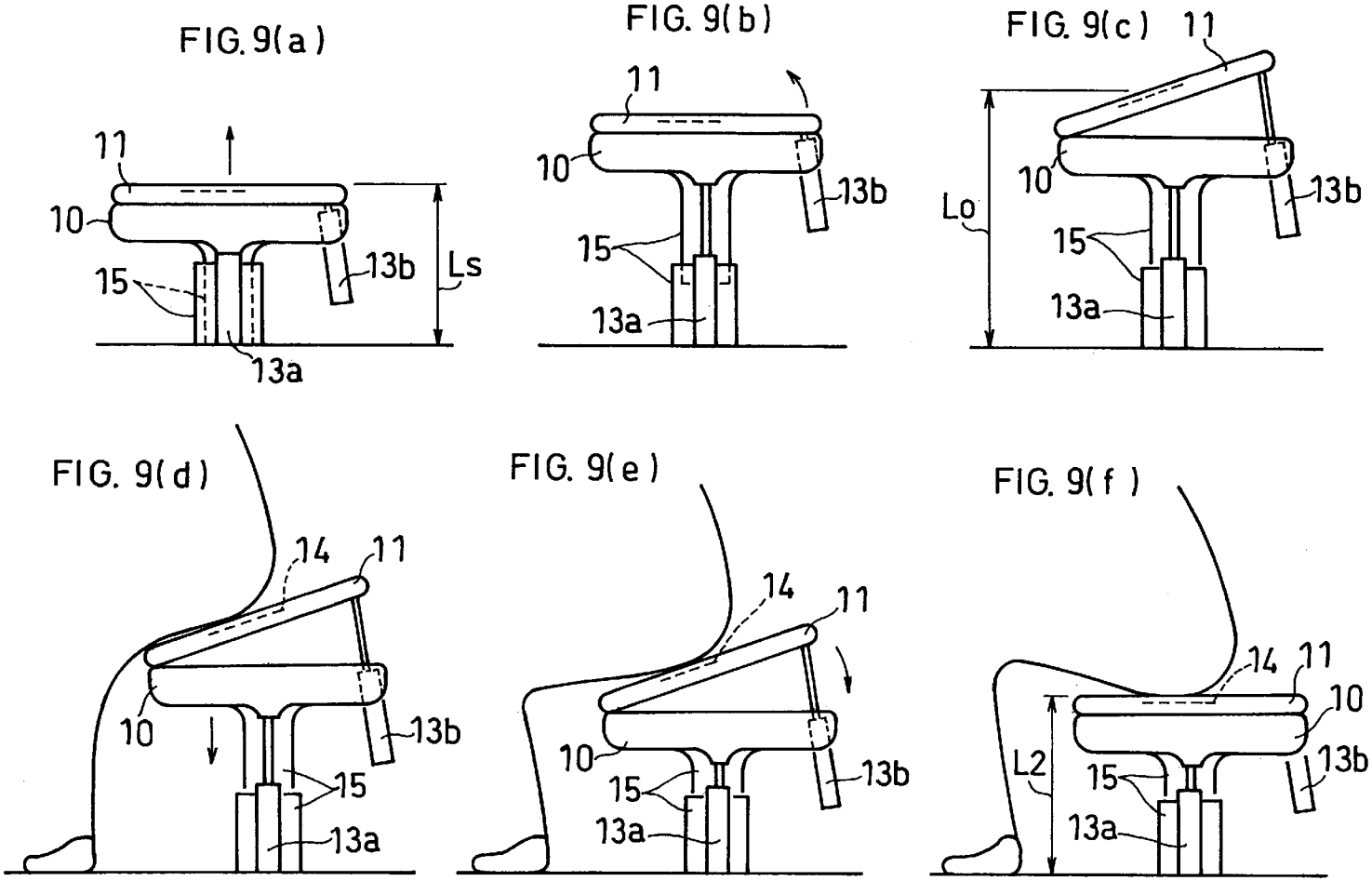
FIGS. 9(*a*) to 9(*f*) are schematic side views showing how to use the Western-style toilet stool

In the case where the load falls within a first range greater than the first liminal value, it is determined that a user has completely leaned the user's hip (sat down) on the seat 11 as shown in FIG. 9(*d*).

A Second Determination: Sitting Condition Determination Stable Sitting Condition (Load>Second Liminal Value)

After the sitting determination, in the case where the load falls within the second range greater than the second liminal value, it is determined that user's sitting condition is stable as shown in FIG. 9(*e*).

In addition, the second liminal value is set to be smaller than the first liminal value. The reason is that the seat 11 lowers after the user has sat down and load applied to the seat 11 generally becomes smaller during lowering.

Unstable Sitting Condition (Load≦Second Liminal Value)

In the case where the load is the second liminal value or less, it is determined that user's sitting condition is unstable.

Thus, the pressure sensor 14 forms a load detection means (sitting detection means) for detecting load information to determine whether the user got seated on the seat 11 or not. And, the microcomputer 1 forms a determination means for determining that the user got seated in the case where output from the pressure sensor 14 falls within a prescribed range.

The CPU 2 causes the driving control means 4 to elevate or lower the seat 11 on the basis of the determined result as described later, while determining and monitoring changes of user's sitting condition.

The second liminal value may be calculated from ratio of the load applied on the seat after a user has sat down. As the registered data by type of user, values calculated from weight, height and seated height of typical infants, healthy adults and the elderly are previously stored in the general registered data storage part 3*a*.

Usage at Home

Figure 6:
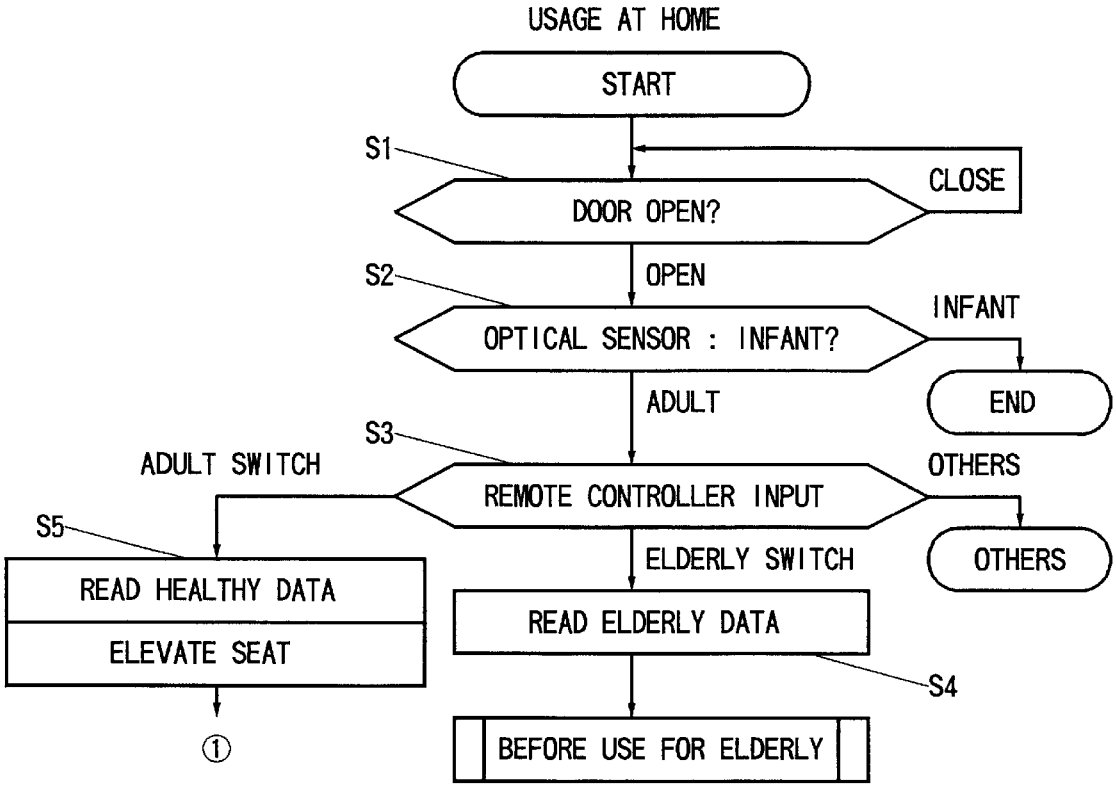
FIG. 6 is a flowchart showing how to use the Western-style toilet stool at home.

Next, common usage of the toilet stool at home will be explained below with reference to flowcharts in FIG. 6 to FIG. 8 and a side view of FIG. 9.

The toilet stool is held at an initial height as shown in FIG. 9(*a*). The initial height is set to be, for example, the seat height Ls when an infant is sitting stored in the general registered data storage part 3*a*. When the toilet stool starts operating, the CPU 2 determines whether the door 7 is opened or not depending on the open signal from the open/close switch 21 in step S1 shown in FIG. 6. When the user opens the door 7 and enters into the toilet room, the CPU 2 receives the open signal from the open/close switch 21 and determines that the door 7 is opened, and then operation proceeds to step S2.

In step S2, the CPU 2 determines which either adult or infant has entered based on a person detection signal from the passage sensor 22. In the case where the user passes in front of the passage sensor 22 and CPU 2 receives the person detection signal from the passage sensor 22, it is determined that an adult has entered the room and the operation proceeds to step S3. Alternatively, in the case where the CPU 2 receives no person detection signal within a prescribed period, it is determined that an infant has entered or no one has entered the toilet room and the operation is terminated.

Therefore, when an infant enters into the room, the initial height of the seat 11 is set to be the seat height for infant Ls (300 mm) and the seat 11 is held at a low position so that even an infant can relieve oneself alone without any help from his/her parent.

In step S3, it is determined whether the type button 24*a* of the remote controller 25 has been pushed or not.

For example, when the type button 24*a* corresponding to healthy adult is pushed, the operation proceeds to step S5. In step S5, the CPU 2 reads out registered data corresponding to healthy adult from the general registered data storage part 3*a* and the driving control means 4 controls the elevating means 13 so as to elevate the seat 11 to the seat height when sitting, and then the operation proceeds to step S35 (FIG. 8) for the processing after use as described later.

In the case where the type button 24*a* corresponding to the elderly is pushed, the operation proceeds to step S4. In step S4, the CPU 2 reads out registered data corresponding to the elderly from the general registered data storage part 3*a* and the operation proceeds to the processing before use by the elderly as shown in FIG. 7. In other cases, other processing is performed.

Before Use by the Elderly

Figure 7:
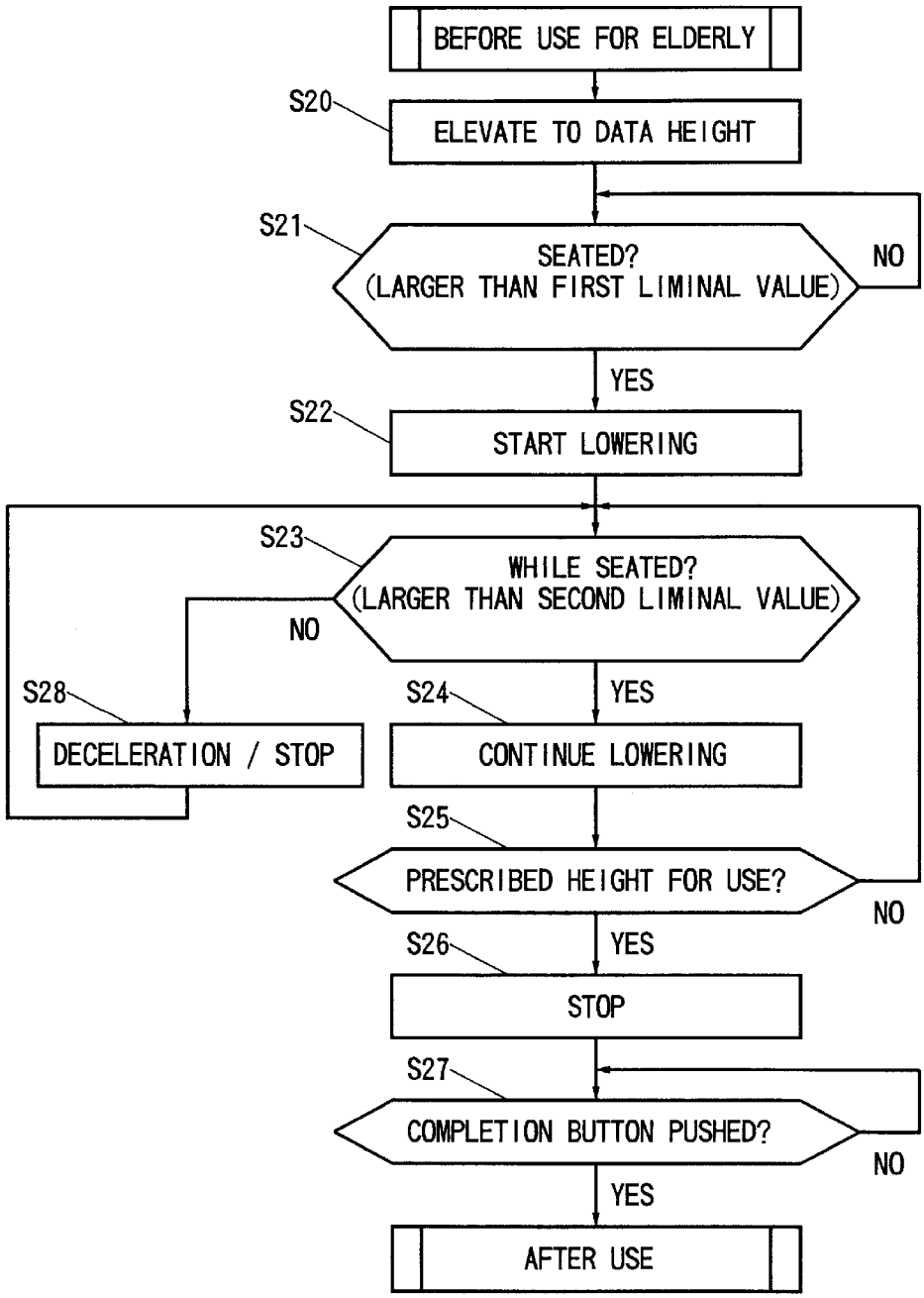
FIG. 7 is a flowchart showing a process for the elderly before relieving oneself.

In step S20 before use by elderly as shown in FIG. 7, the elevating means 13*a* elevates the seat 11, and the inclining means 13*b* causes the seat 11 to be inclined toward front thereof as shown in FIG. 9(*c*). That is, the seat 11 is elevated from the initial height (seat height for infant) Ls as shown in FIG. 9(*a*) to the seat height for the elderly Lo as shown in FIG. 9(*c*). After that, the operation proceeds to step S21.

In step S21, the CPU 2 calculates the load based on the pressure signal from the pressure sensor 14 and determines whether the user is seated or not. As shown in FIG. 9(*d*), in the case where the user sits down on the seat 11, resulting in that the load exceeds the first liminal value, the operation proceeds to step S22.

In step S22, the elevating means 13*a* and the inclining means 13*b* causes the seat 11 to lower and the operation proceeds to step S23

In step S23, the CPU 2 determines the user's sitting condition. As shown in FIG. 9(*e*), in the case where the user remains seated with the full weight, i.e., the load exceeds the second liminal value, it is determined that user's sitting condition is stable and the operation proceeds to step S24. On the contrary, in the case where the user reseats himself/herself or stands up and therefore the load becomes the second liminal value or less, the operation proceeds to step S28.

In step S28, the lowering of the seat 11 is suspended and the operation proceeds to step S23. Also in step S28, it is possible to decrease the lowering rate of the seat 11, to stop lowering the seat 11 after deceleration, or to elevate the seat 11.

In step S24, the seat continues to lower and the operation proceeds to step S25.

In step S25, it is determined whether the height of the seat 11 has reached at the seat height when relieving oneself or not. In the case where the seat 11 lowers to the seat height when relieving oneself, the operation proceeds to step S26. On the contrary, in the case where the height of the seat 11 has not reached at the seat height when relieving oneself, the operation returns to step S23.

In step S26, after the seat 11 stops lowering, the operation proceeds to step S27.

Accordingly, as shown in FIGS. 9(*d*) to 9(*f*) the seat 11 lowers with the user seated thereon so that the user can gradually take a posture in relieving oneself.

In step S27, it is determined whether the completion button 24*d* of the remote controller 25 has been pushed or not. When the user completes relieving oneself and pushes the completion button 24*d*, water injection-typed washer, drier and so on initiate the processing such as cleaning of the toilet stool after relieving oneself. After the processing, the operation proceeds to the processing after use as shown in FIG. 8.

After Use

Figure 8:
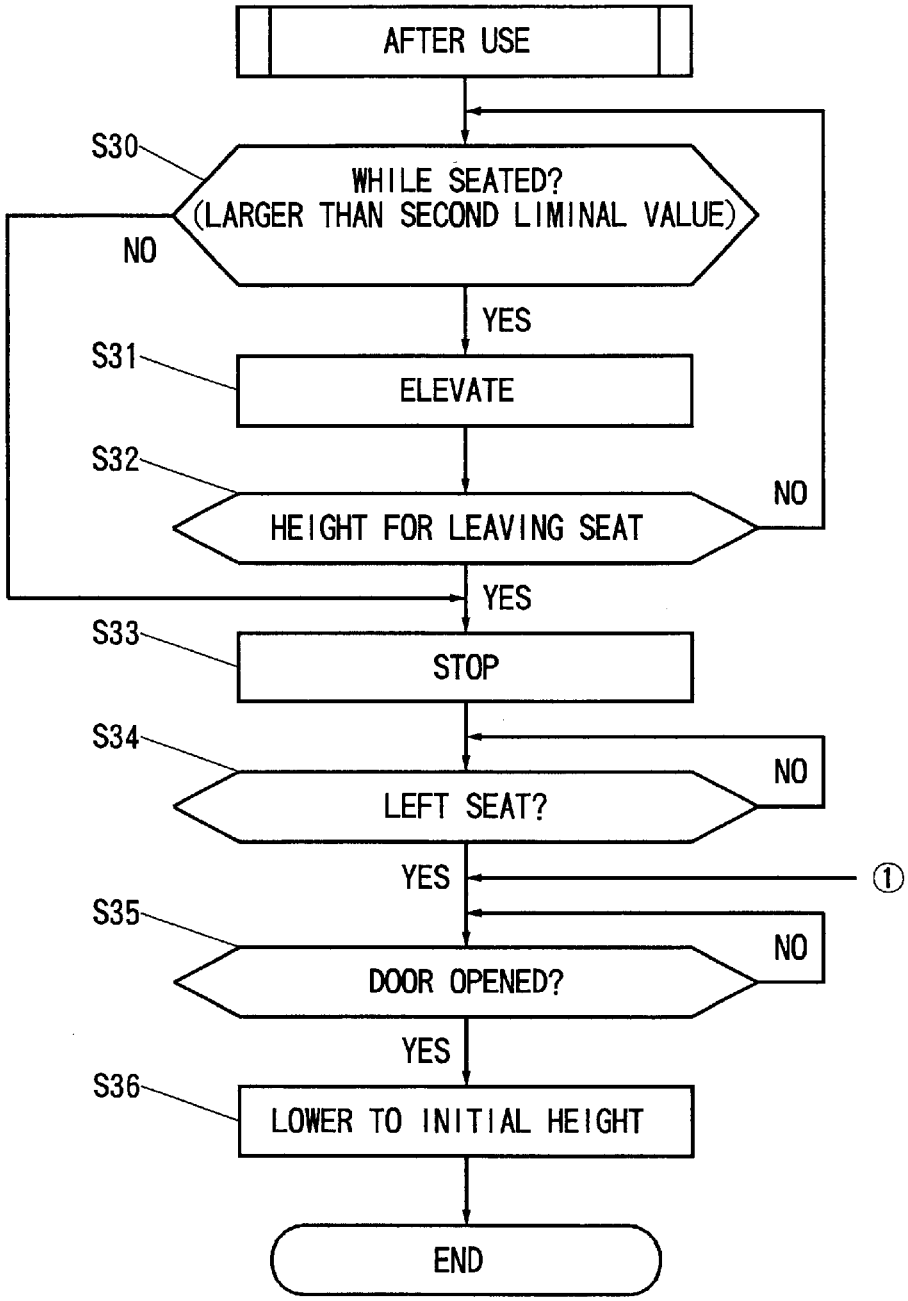
FIG. 8 is a flowchart showing a process after relieving oneself.

As shown in FIG. 8, in step S30 after relieving oneself, the CPU 2 determines user's sitting condition. In the case where the load calculated on the basis of the pressure signal from the pressure sensor 14 is larger than the second liminal value, it is determined that the user's sitting condition remains stable and the operation proceeds to step S31. Alternatively, in the case where the load is equal to the second liminal value or less, the operation proceeds to step S33.

In step S31, the elevating means 13*a* and the inclining means 13*b* elevate the seat 11. The user is forced to raise his/her hip by the seat 11 in a seated posture and the operation proceeds to step S32.

In step S32, it is determined whether the height of the seat 11 has reached at the seat height for the elderly when sitting. In the case where it has reached at the seat height Lo, the operation proceeds to step S33. Alternatively, in the case where it has not reached at the seat height Lo, the operation returns to step S30.

In step S33, after the lowering of the seat 11 is suspended, the operation proceeds to step S34.

Accordingly, the seat 11 is elevated with the user seated thereon, thereby gradually raising the user's hip to a height where the user can easily stand up.

In step S34, the CPU 2 compares the third liminal value stored in the general registered data storage part 3*a* with the load to determine whether the user has left the seat or not. In the case where the user stands up and the load becomes equal to the third liminal value (e.g. 0.5 kg) or less, the operation proceeds to step S35.

In step S35, in the case where CPU 2 determines that the door is opened based on the open signal from the open/close switch 21, the operation proceeds to step S36.

In step S36, after drainage, the process is completed by lowering the seat 11 to the initial height Ls and gets prepared for next user's entering.

Use in Facilities

Next, usage in nursing facilities such as home for elderly people will be explained below.

As shown in FIG. 3(*c*), in the additional personal data storage part 3*b*, each user's personal data consisting of identification number, level information (seat height when sitting and relieving oneself), the first liminal value and the second liminal value is interrelated and stored. The CPU 2 comprises a registration mode for making additional registration or change of personal data in the additional personal data storage part 3*b* and an operational mode for operating the toilet stool. As described later, in the registration mode, by operating the setting button 24*c* of the setting area 25*c* on the remote controller 25 as shown in FIG. 4, the personal data is registered.

Read/write Device (User Identifying Means)

As shown in FIG. 1, the read/write device 30 is attached to the door 7. The read/write device 30, which is connected to the microcomputer 1, records information in the identification tag T shown in FIG. 5(*a*) as well as reads out the information from the identification tag T.

Hereinafter, the identification tag T and the read/write device 30 used in the present embodiment will be explained briefly.

As shown by dashed line, the identification tag is disc-shaped and fixed at a band B like a wristwatch for attaching to wrist of the elderly.

As shown in FIG. 5(*b*), an antenna controller 31 provided within the read/write device 30 transmits a command for reading information recorded in the identification tag T in certain cycle to an oscillator 32. In the presence of the identification tag T within a prescribed area, electromagnetic induction generated between a transmitting coil L1 of the antenna 35*a*, 35*b* and a transmitting/receiving coil L3 of the identification tag T allows a control circuit 110 of the identification tag T to read information within an EEPROM 111. The control circuit 110 of the identification tag T inputs reverberation corresponding to the information to the transmitting/receiving coil L3. When the reverberation is received by a receiving circuit 34 due to electromagnetic induction generated between the transmitting/receiving coil L3 and a receiving coil L2 of the antenna 35*a*, 35*b*, the received reverberation is demodulated by a demodulation circuit 33 to output to the antenna controller 31. The antenna controller 31 outputs the demodulated information to the microcomputer 1.

In the case that information is made to be recorded in the identification tag T, the antenna controller 31 transmits information to be recorded in the identification tag T and a command to record the information in the identification tag T. The information and the command are transmitted/received due to electromagnetic induction generated between the transmitting coil L1 and the transmit/receive coil L3 and causes the control circuit 110 of the identification tag T to record the information in the EEPROM 111.

Similar electromagnetic-system identification tag T and read/write device are disclosed in, for example, paragraph [0013] or [0014] of Japan Unexamined Patent Publication No. 10-75879 and V700 series made by Omron Corporation can be adopted as such devices.

In the registration mode, there is recorded personal identification number (identification information for identifying the user) that corresponds to the identification number stored in the additional personal data storage part 3*b* (FIG. 3(*c*)) and so on in the identification tag T.

Meanwhile, in the operation mode, the CPU 2 shown in FIG. 3(*a*) reads out the personal identification number from the identification tag T via the read/write device 30 and compares it with the identification number stored in the additional personal data storage part 3*b*, thereby identifying the user and reading personal data of the user. Therefore, the identification tag T and the read/write device 30 forms a user identification means for identifying the user.

Usage in Facilities

In using the means in facilities, the identification tag T is attached to one wrist of each elderly person. As the read/write device 30 is formed on the door 7, the identification tag T is attached to the wrist that opens the door 7 in consideration of communication distance between the read/write device 30 and the identification tag T.

Registration Mode

In the case of using the toilet stool in facilities, personal data of users is registered prior to use.

A caregiver sets the CPU 2 in registration mode with the remote controller 25 and then inputs registrant name "User A" and weight of the aged user to be registered. The CPU 2 performs a prescribed operation based on the input weight to calculate the first and second liminal values. Moreover, when the caregiver moves the main body 10 to the optimum seat height for the elderly both when sitting and relieving oneself with the remote controller 25 and carries out given operations, the CPU 2 assigns the identification number to registrant name, the first and second liminal value and the seat height and interrelate them to additionally store them in the additional personal data storage part 3*b*.

After that, when given operations are carries out while holding the identification tag T attached to the elderly person over the read/write device 30, the read/write device 30 causes the identification tag T to record the identification number therein. After recording, the CPU 2 is returned in the operation mode with the remote controller 25. The initial seat height after return is set to be 400 mm, for example.

Operation Mode

Figure 10:
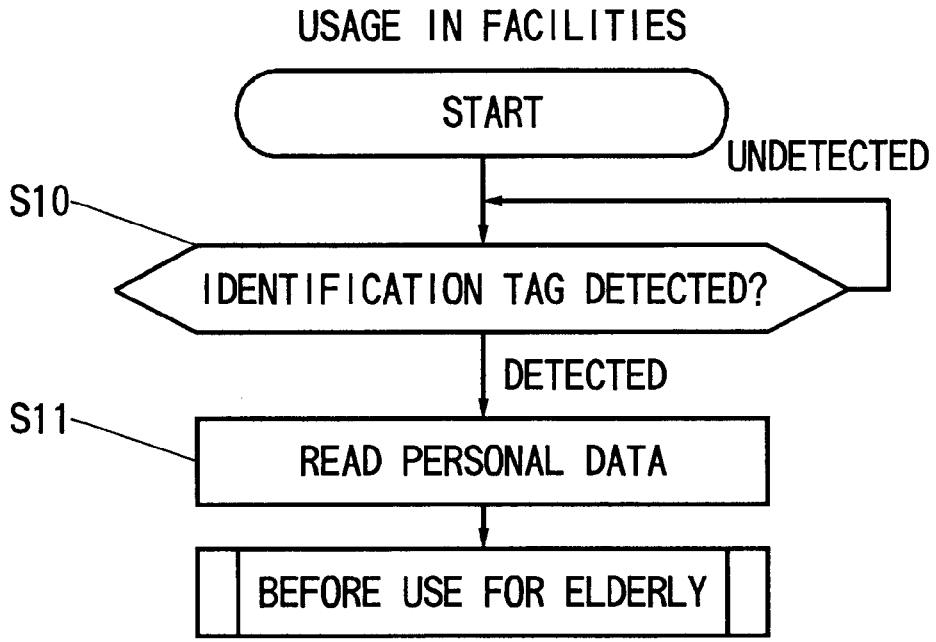
FIG. 10 is a flowchart showing how to use the Western-style toilet stool at facilities.

Next, usage of the toilet stool in facilities will be explained below with reference to a flowchart of FIG. 10.

The toilet stool is held at the predetermined initial height. On putting the toilet stool into operation, it is determined whether the read/write device 30 has detected the identification tag T or not in step S10. When the user turns the doorknob and opens the door 7, the identification tag T comes close to the read/write device 30. As a result, the read/write device 30 detects the identification tag T and reads out the identification number from it, and then the operation proceeds to step S11.

In step S11, the CPU 2 reads personal data corresponding to the identification number read out by the read/write device 30 from the additional personal data storage part 3*b* and the operation proceeds to the processing before use by the elderly as shown in FIG. 7. In this case, elevating height of the seat 11 varies according to the elderly person stored in the additional personal data storage part 3*b*. Before use by the elderly, the seat 11 is controlled in accordance with the read personal data and the processing after use by the elderly as shown in FIG. 8 is performed based on the personal data. Moreover, after relieving oneself, the height of the seat 11 returns to the initial height of 400 mm.

Figure 11:
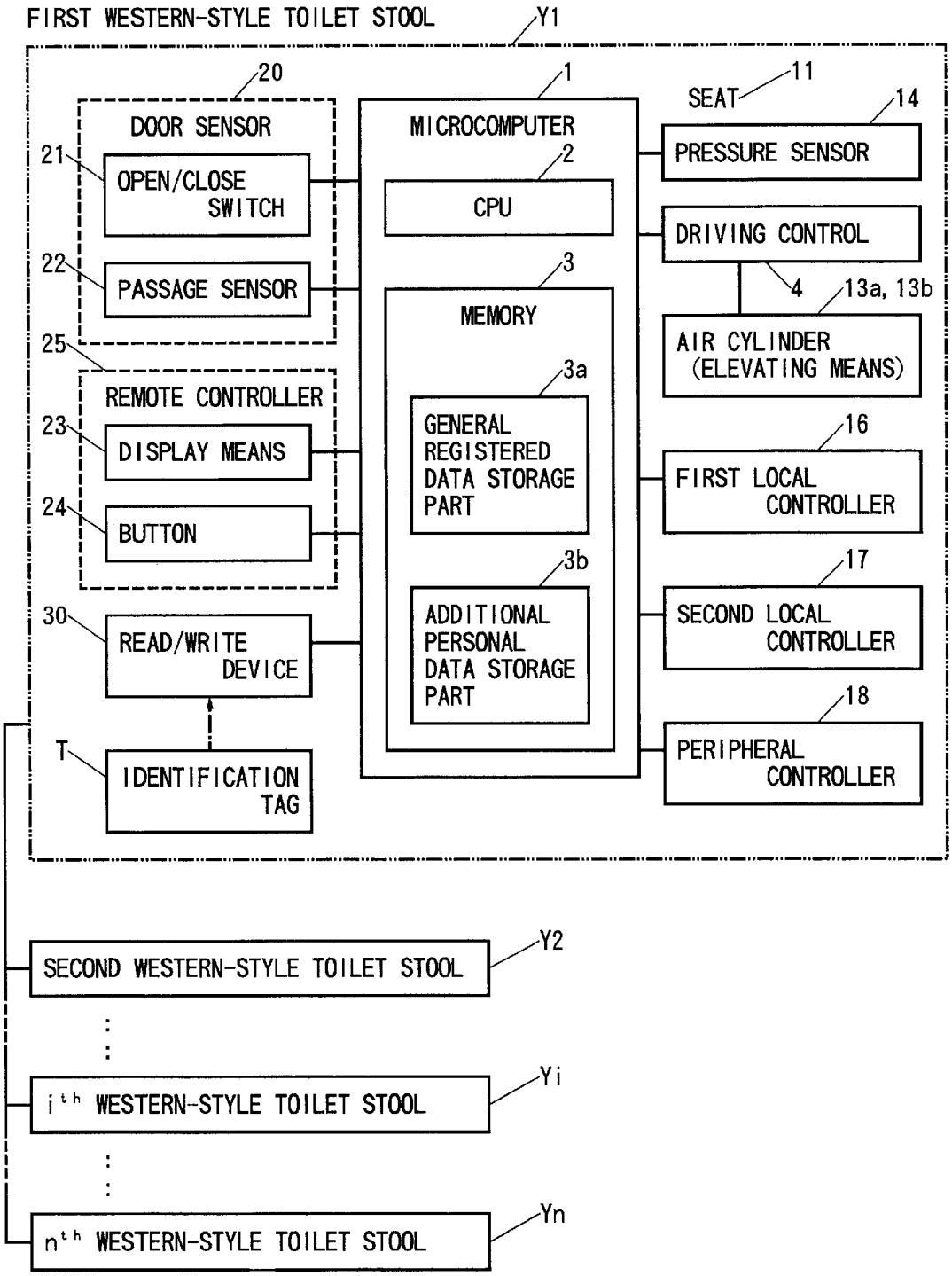
FIG. 11 is a schematic structural diagram showing the case where Western-style toilet stools are connected with each other.

In the case of using in facilities, as shown in FIG. 11, Western-style toilet stools Y1 to Yn may be connected to each other via a communication means such as LAN. Therefore, personal data stored in the memory 3 of the microcomputer 1 of a toilet stool Yi may be also stored in the memories of other toilet stools.

Also, although the pressure sensor (sitting detection means) is provided with the seat 11 in this embodiment, it is not necessarily provided with the seat 11. For example, a detection means such as a pressure sensor or load cell may be formed on the floor beneath the user's feet when sitting.

Further, in the case where the height of the seat 11 is adjusted finely during relieving oneself with the remote controller 25, the renewed height may be saved in the memory 3.

Structure of Cleaning Mechanism

The toilet stool comprises a cleaning mechanism for cleaning the toilet stool automatically. This cleaning mechanism will be explained hereinafter.

As shown in FIG. 1, stationary nozzle heads (injection means) 41 and rotating nozzle heads (injection means) 42 are formed on an inner surface, that is, bottom surface of the cover 12. Each stationary nozzle head and rotating nozzle head have a first nozzle 41*a* and a second nozzle 42*a*, respectively. As described later, the nozzles 41*a* and 42*a* perform a cleaning operation by spraying pressure liquid for cleaning the toilet stool. Moreover, as described later, cleaning liquid such as detergent or hot water in addition to water is utilized as the pressure liquid.

Stationary Nozzle Head 41

Figure 12A:
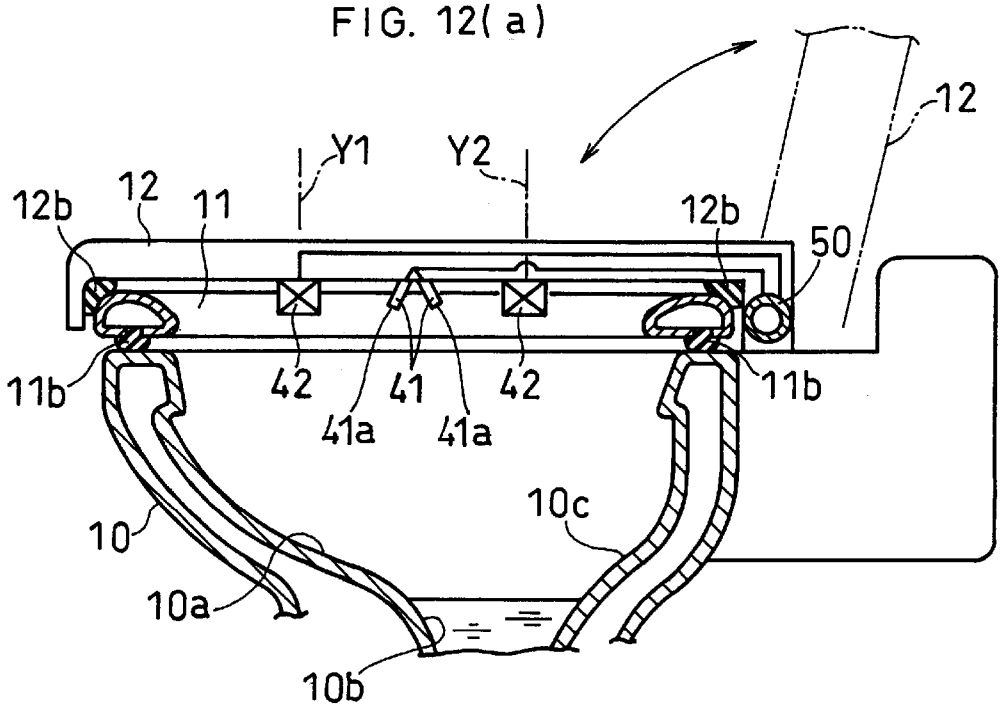
FIG. 12(*a*) is a longitudinal sectional view and FIG. 12(*b*) and FIG. 12(*c*) are partially sectional views of a lock means.
Figure 12B:
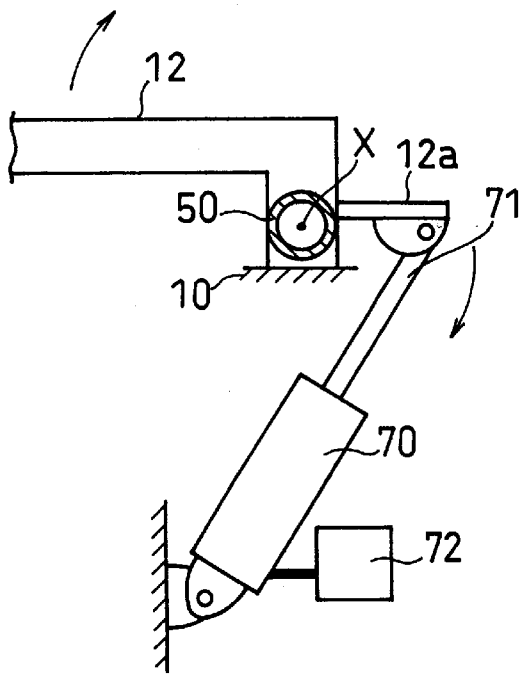

As shown in FIG. 12(*a*), two stationary nozzle heads 41, 41 in a pair are formed on the inner surface of the cover 12. Each of the stationary nozzle heads 41, 41 has the first nozzle 41*a* at front edge thereof. The first nozzles 41*a* are set to inject liquid in different directions with each other.

Here, a water reservoir lob for storing stool temporally is formed inside of the lower portion of the main body 10. A ball surface 10*a* with a gentle slope is formed forward of the water reservoir 10*b*. A rearward surface 10*c* with a steeper slope than that of the ball surface 10*a* is formed rearward of the water reservoir 10*b*.

As shown in FIG. 16(*c*), the first nozzles 41*a* injects water to inner surface of the main body 10 including the ball surface 10*a* and the rearward surface 10*c*.

Rotating Nozzle Head 42

The rotating nozzle head 42 shown in FIG. 12(*a*) is provided backward and forward of the pair of stationary nozzle heads 41, respectively. The rotating nozzle heads 42 are constructed to be rotatable about their respective vertical axes Y1 and Y2 that are apart from each other in the horizontal direction while the cover 12 is closed. As shown in FIG. 13(*a*), each of the rotating nozzle heads 42 is formed in the shape of a cross and comprises plural second nozzles 42*a*. The plural second nozzles 42*a* are located so that couple moment due to injection pressure of liquid makes the rotating nozzle head 42 rotate about their respective axes Y1 and Y2 in one direction. The injection directions of the second nozzles 42*a* are set to be horizontal, upward slanting and downward slanting directions, respectively.

As shown in FIG. 13(*b*), each of the rotating nozzle heads 42 is rotatably attached to a tube 44 fixed to the cover 12 via a mechanical seal 43. Thus, each of the rotating nozzle heads 42 rotates about the axis Y1 (Y2), thereby injecting liquid over the surface of the seat as shown in FIG. 16(*e*).

As described above, since one of the second nozzles 42*a* is set to inject the liquid in the horizontal direction, the rotation enables one rotating nozzle head 42 to clean the other rotating nozzle head 42.

Piping Structure of Cleaning Mechanism

Figure 14:
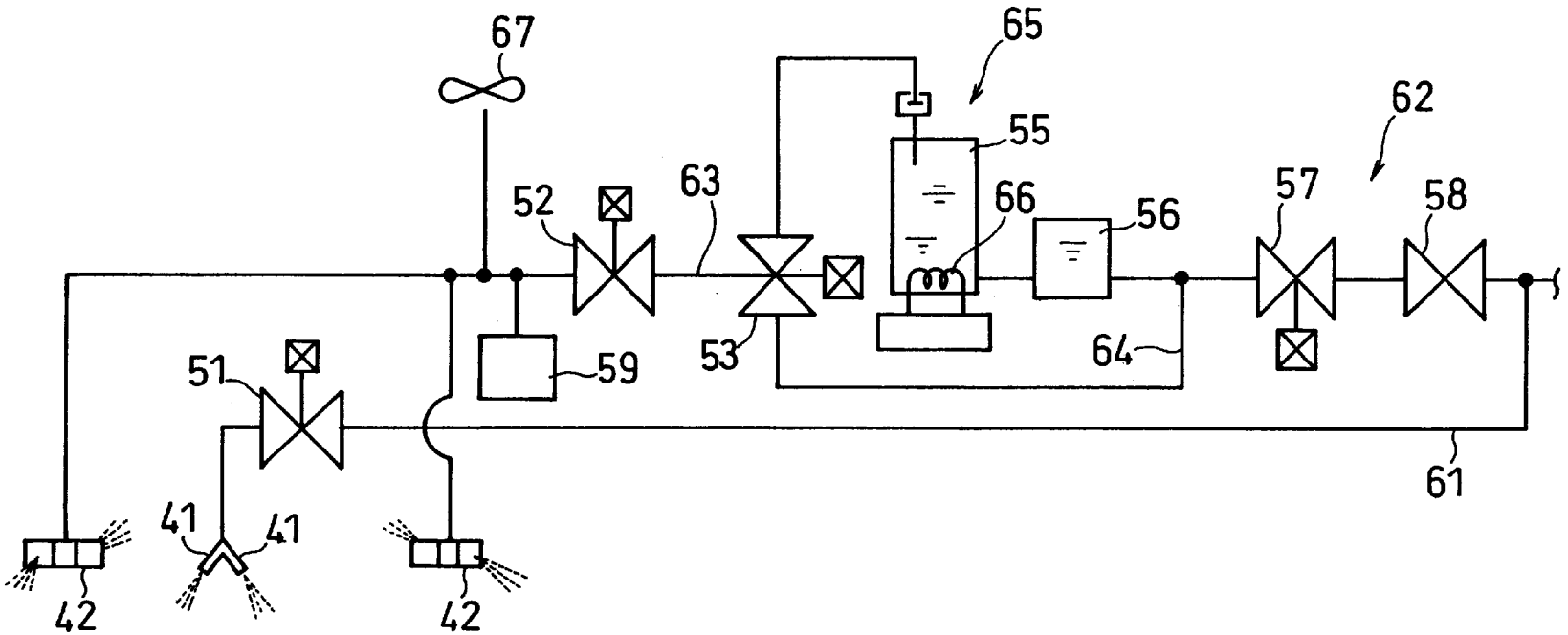
FIG. 14 is a piping diagram of a cleaning mechanism.

As shown in FIG. 14, the cleaning mechanism is connected to a plumbing. Water from the plumbing branches into a first conduit 61 and a second conduit 62. The first conduit 61 is connected to the stationary nozzle heads 41 via a first electromagnetic valve 51. The first nozzles 41*a* start or stop water injection by opening or closing the electromagnetic valve 51.

The second conduit 62 is connected to a decompression valve 58 and a primary electromagnetic valve 57 in that order from upstream. In the downstream from the primary electromagnetic valve 57, the second conduit 62 branches into a hot-water way 65 and a cold-water way 64. The hot-water way is connected to a sub tank 56 and a hot-water storage tank 55 in series. The hot-water tank 55 has a heater 66 therein. The heater 66 heats water in the hot-water tank 55 to a prescribed temperature. Hot water in the hot-water tank 55 and water in the cold-water way 64 are mixed by a mixture valve 53 at a prescribed ratio and runs into a third conduit 63.

The third conduit 63 is connected to a second electromagnetic valve 52, a cleaning liquid tank 59 and a warm-air fan 67 in that order from upstream. In the downstream from the warm-air fan 67, the third conduit 63 branches into each rotating nozzle head 42.

The second electromagnetic valve 52 can start or stop injection of pressure liquid from the second nozzles 42*a* as well as vary injection pressure to any given value at the time of injection.

The discharge pressure of liquid injected from the second nozzles 42*a* is reduced by the decompressed valve 58 so as to be smaller than that of water injected from the first nozzles 41*a*. Therefore, the relation between the nozzles 41*a* and the nozzles 42*a* in discharge pressure are represented in the following expression (1).

The first nozzle 41*a*>The second nozzle 42*a* at maximum pressure>The second nozzle 42*a* at minimum pressure (1)

Further, the cleaning liquid tank 59 and the warm-air fan 67, respectively are connected to an electromagnetic valve not shown and cause cleaning liquid or warm air to inject from the rotating nozzle heads 42 at a prescribed timing as described later.

Rubber Packing

As shown in FIG. 12(*a*), an annular rubber packing 12*b* is placed on the rim of inner surface of the cover 12. While the seat 11 is closed, the rubber packing 12*b* is in close contact with the top surface of the seat 11, thereby sealing between the cover 12 and the seat 11.

At the bottom surface of the seat 11, an annular rubber seal 11*b* is provided. While the seat 11 is closed, the rubber seal 11*b* is in close contact with the main body 10, thereby sealing between the seat 11 and the main body 10.

Lock Means

As shown in FIG. 12(*b*), the cover 12 is provided so as to rotate about a horizontal axis X (FIG. 1) via a hinge 50. That is, the cover 12 can close or open with respect to the main body 10 by rotating about the axis X.

At the rear end of the cover 12, a projection 12*a* is provided integral with the cover 12. A front end of a link 71 is rotatably connected to the projection 12*a*. A rear end of the link 71 is connected to an air cylinder 70 that enables the link 71 to extend or contract by means of an electromagnetic valve 72.

Figure 12C:
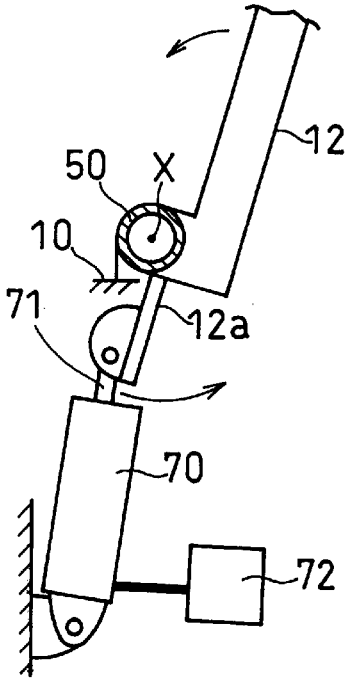
Figure 13A:
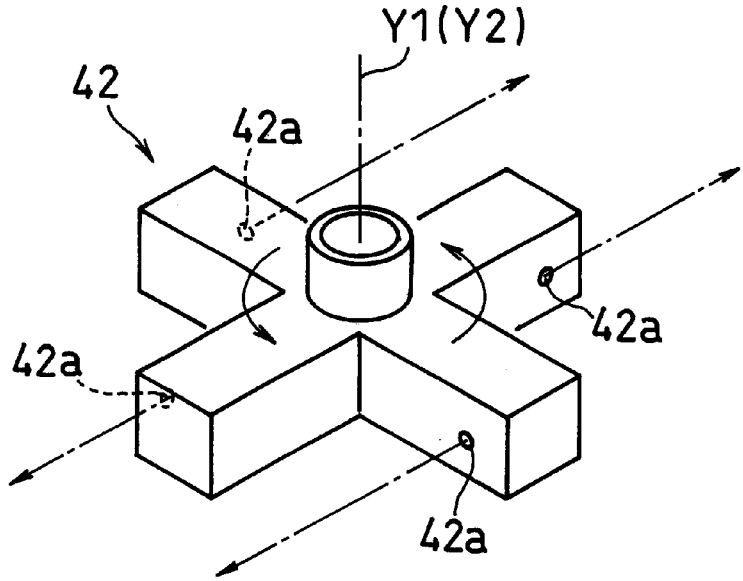
FIG. 13(*a*) is a perspective view and FIG. 13(*b*) is a longitudinal sectional view of a second nozzle.
Figure 13B:
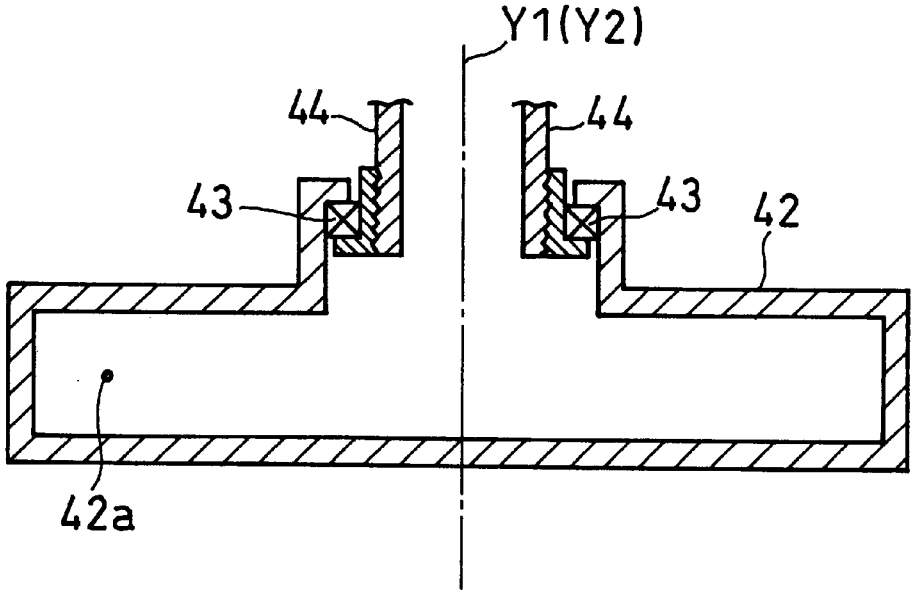

When the air cylinder 70 allows the link 71 to contract by means of an electromagnetic valve 72 when the cover 12 is closed as shown in FIG. 12(*b*), the projection 12 rotates about the axis X in clockwise direction and the cover 12 opens as shown in FIG. 12(C). Alternatively, when the link 71 extends, the projection 12 rotates in anticlockwise direction and the cover 12 closes as shown in FIG. 12(*b*).

At that time, when the electromagnetic valve 72 is shut down, air pressure of the electromagnetic valve 72 on the air cylinder 70 is hold at a prescribed magnitude. For this reason, the link 71 becomes stationary in extended state and the projection 12*a* is maintained at the location, resulting in that the cover 12 is locked to the closed state.

Thus, the air cylinder 70, link 71, and electromagnetic valve 72 form a lock means for locking the cover 12 to the closed state.

Control Structure of Cleaning Mechanism

As shown in FIG. 3(*a*), the microcomputer 1 is connected to a first local controller 16, a second local controller 17 and a peripheral controller 18 in addition to the above-mentioned devices. The first and second local controllers 16 and 17 control the electromagnetic valves 51 to 53 and 57 and so on provided in each conduit, thereby causing the stationary nozzle heads 41 and the rotating nozzle heads 42 to perform the cleaning operation as described later, on the condition that the cover 12 is closed.

The peripheral controller 18 controls operations of the warm-air fan 67 and the heater 66 and so on.

The CPU 2 has a cleaning mode for cleaning the toilet stool other than the registration mode and the operation mode.

Cleaning Operation

Figure 15:
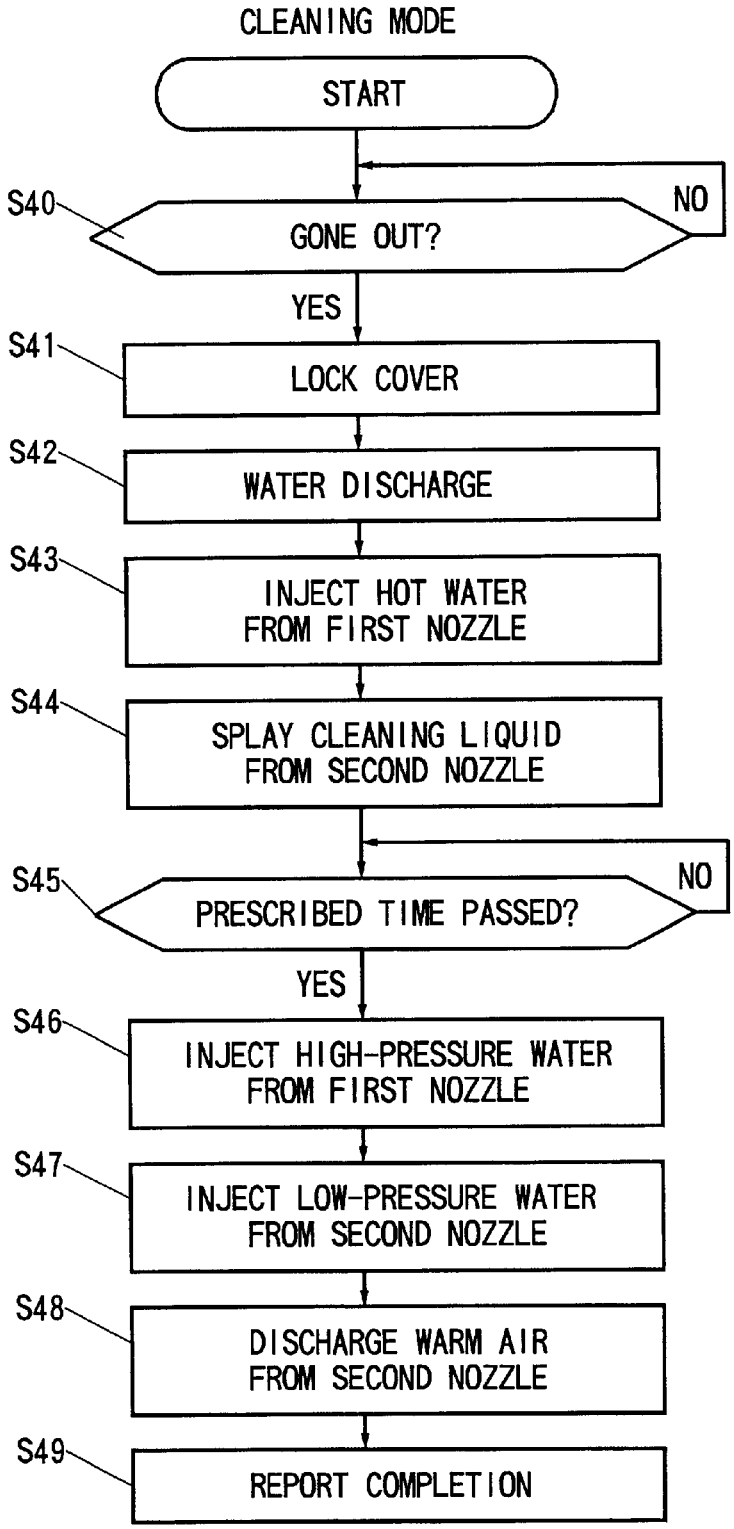
FIG. 15 is a flowchart showing a cleaning mode.
Figure 16A:
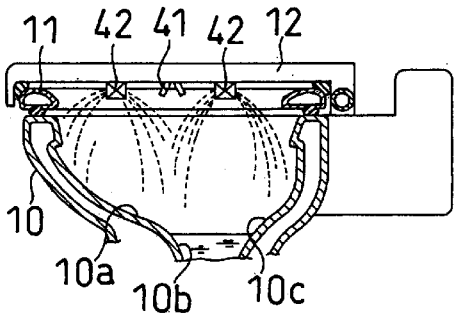
FIGS. 16(*a*) to 16(*f*) are longitudinal sectional views of the Western-style toilet stool showing how to clean.
Figure 16B:
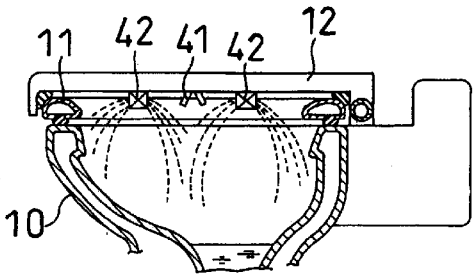
Figure 16C:
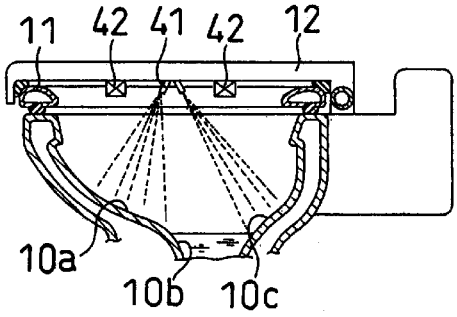
Figure 16D:
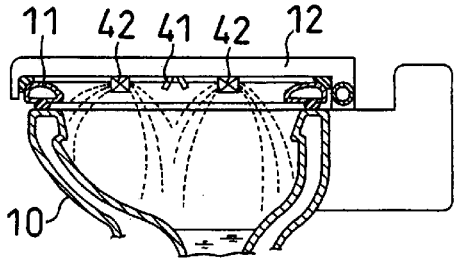
Figure 16E:
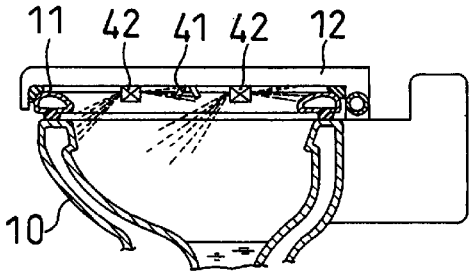
Figure 16F:
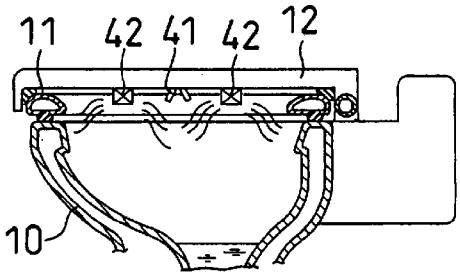

Next, the automatic cleaning operation will be explained below with reference to the flowchart of FIG. 15 and the operational diagram of FIGS. 16(*a*) to 16(*f*). In the case where the door 7 or the cover 12 is opened or closed during the cleaning operation of the toilet stool as described below, the cleaning operation is stopped immediately.

In cleaning the toilet stool, during the period of fewer users such as late night, a worker performs given operations with the remote controller 25 and sets the microcomputer 1 in the cleaning mode. This activates the cleaning mode and the operation proceeds to step S40 as shown in FIG. 15.

In step S40, the microcomputer 1 determines whether the worker has gone out of the toilet room or not. That is, the microcomputer 1 determines whether the door 7 is opened or closed on the basis of the open/close signal from the open/close switch 21. When the worker goes out of the toilet room and closes the door 7, the microcomputer 1 receives the close signal and determines that the door 7 is closed. In the case where the microcomputer 1 receives the close signal and receives no person detection signal within a prescribed period, it is determined that the worker has gone out of the toilet room and the operation proceeds to step S41.

In step S41, the microcomputer 1 brings the electromagnetic valve 72 into operation so as to close the cover 12 if opened. The cover 12 thus closed is locked by the lock means so as not to be opened, and the operation proceeds to step S42.

In step S42, in case that stool still remains, water is flushed into the main body 10 and the operation proceeds to step S43.

In step S43, the microcomputer 1 opens the second electromagnetic valve 52, thereby causing the second nozzles 42*a* to inject hot water and increasing the temperature within the toilet stool, and the operation proceeds to step S44. At that time, the microcomputer 1 activates the mixture valve 53 to mix hot water and cold water so that hot water injected from the second nozzles 42*a* reaches a prescribed temperature. Alternatively, when the microcomputer 1 turns down the second electromagnetic valve 52 so as to inject water at minimum pressure, the rotating nozzle head 42 rotates slowly and injects hot water into main body 10 evenly.

In step S44, the microcomputer 1 mixes the hot water with cleaning liquid in the cleaning liquid tank 59 and causes the second nozzles 42*a* to inject the mixture at minimum pressure (FIG. 16(*b*)) and the operation proceeds to step S45.

In step S45, it is determined whether predetermined time has passed or not. In the case where the predetermined time has passed, the operation proceeds to step S46. After heated by the injection of hot water, inner surface of the main body 10 is left coated with the cleaning liquid during a determined period, thereby reinforcing a cleaning effect.

In step S46, the microcomputer 1 opens the first electromagnetic valve 51, thereby making the first nozzles 41*a* inject water at high pressure (FIG. 16(*c*)) and the operation proceeds to step S47. Water injected from the first nozzles 41*a* at high pressure directly hits against the ball surface 10*a* and the rearward surface 10*c* that are apt to be dirty, removing the smudge on them.

In step S47, the microcomputer 1 shuts the mixture valve 53 on the side of hot water, and at the same time, opens the second electromagnetic valve 52, thereby causing the second nozzles 42*a* to inject water, and then the operation proceeds to step S48. Firstly, water is injected from the second nozzles 42*a* at minimum pressure as shown in FIG. 16(*d*) and cleans whole inside of the main body 10, washing away the spattered smudge with the first nozzles 41*a*. After that, discharge pressure is gradually made larger and water is finally injected at maximum pressure to clean the seat 11 and upper part of the main body 10 as well as the rotating nozzle heads 42 from each other, as shown in FIG. 16(*e*).

In step S48, warm air from the warm-air fan 67 is blown through the second nozzles 42*a*, thereby blasting off and evaporating droplets and the operation proceeds to step S49.

In step S49, the microcomputer 1 displays an expression such as "Cleaning Completed" on a display means 23 of the remote controller 25 and the cleaning mode is finished.

While the preferred embodiments of the present invention have been described above with reference to the appended drawings, it will be easily understood by one skilled in the art from the specification that various changes and modifications can be made therein within the obvious scope.

For example, although a pair of rotating nozzle heads is provided in the embodiment, three rotating nozzle heads may be adopted. Alternatively, one rotating nozzle head may be located in the center of the cover.

Moreover, the cleaning mode may be initiated after each use. It may be also set so as to start at a predetermined time automatically by providing a timer. Alternatively, it may be set to start automatically only after the elderly person's use.

Further, as a lock means, it is possible to fix the forward part of the cover at the main body, thereby preventing the cover from opening.

Further, it is possible to form a rickrack between the main body and the seat to seal between them when inclining the seat.

Furthermore, the first nozzle and the second nozzle may inject water simultaneously.

Furthermore, discharge pressure from the first nozzle may be increased with a pressure device or decreased by a decompression valve.

Therefore, it is understood that such changes and modifications fall within the scope of the present invention defined by claims.

What is claimed is:

1. A toilet stool usable in a sitting posture, comprising:

a main body capable of reserving stool temporarily;

a seat provided on said main body;

a cover that performs opening and closing operations by rotating about a horizontal axis with respect to said main body;

injection means for performing a cleaning operation by injecting pressure liquid for cleaning; and control means that causes said injection means to perform said cleaning operation on the condition that said cover is closed, wherein said injection means are provided on an inner surface of said cover, said injection means comprising:

a first nozzle injecting said liquid into an inner surface of said main body; and a second nozzle injecting said liquid to a top surface of said seat, wherein said control means controls injection of said liquid by said first nozzle and second nozzle so that injection of said liquid by said first nozzle completes after injection of said liquid by said second nozzle has completed.

2. A toilet stool usable in a sitting posture, comprising:

a main body capable of reserving stool temporarily;

a seat provided on said main body;

a cover that performs opening and closing operations by rotating about a horizontal axis with respect to said main body;

injection means for performing a cleaning operation by injecting pressure liquid for cleaning; and control means that causes said injection means to perform said cleaning operation on the condition that said cover is closed, wherein said injection means are provided on an inner surface of said cover, said injection means comprising:

a first nozzle injecting said liquid into an inner surface of said main body; and a second nozzle injecting said liquid to a top surface of said seat, wherein said second nozzle is connected to a decompression valve, said decompression valve decreasing liquid pressure so that liquid discharge pressure of said second nozzle id kept smaller than that of said first nozzle.

3. A toilet stool usable in a sitting posture, comprising:

a main body capable of reserving stool temporarily;

a seat provided on said main body;

a cover that performs opening and closing operations by rotating about a horizontal axis with respect to said main body;

injection means for performing a cleaning operation by injecting pressure liquid for cleaning; and control means that causes said injection means to perform said cleaning operation on the condition that said cover is closed, wherein said injection means are provided on an inner surface of said cover, said injection means comprising:

a first nozzle injecting said liquid into an inner surface of said main body; and a second nozzle injecting said liquid to a top surface of said seat, wherein said second nozzle is connected to a decompression valve, said decompression valve decreasing liquid pressure so that liquid discharge pressure of said second nozzle is kept smaller than that of said first nozzle, wherein said decompression valve can adjust liquid pressure and said control means controls said decompression valve so that liquid pressure reduce by said decompression valve is decreased gradually during said injection.

4. A toilet stool usable in a sitting posture, comprising:

a main body capable of reserving stool temporarily;

a seat provided on said main body;

a cover that performs opening and closing operations by rotating about a horizontal axis with respect to said main body;

injection means for performing a cleaning operation by injecting pressure liquid for cleaning; and control means that causes said injection means to perform said cleaning operation on the condition that said cover is closed, wherein said injection means are provided on an inner surface of said cover, said injection means comprising:

a first nozzle injecting said liquid into an inner surface of said main body; and plural second nozzle being formed to be rotatable about substantially vertical axes that are apart from one another in the horizontal direction and rotating due to liquid pressure, wherein said plural second nozzles are provided on an inner surface of said cover and set to inject the liquid at least in the horizontal direction, whereby said plural second nozzle inject said liquid to a top surface of said seat and clean one another.

5. A toilet stool usable in a sitting posture, comprising:

a main body capable of reserving stool temporarily;

a seat provided on said main body;

a cover that performs opening and closing operations by rotating about a horizontal axis with respect to said main body;

injection means for performing a cleaning operation by injecting pressure liquid for cleaning;

control means that causes said injection means to perform said cleaning operation on the condition that said cover is closed, elevating means for elevating or lowering said seat;

detection means for detecting load information to determine whether a user has sat down on said seat or not;

first determination means for determining that said user has sat down in the case where output from said detection means falls within a first prescribed range; and second determination means for determining condition of said user is stable in the case where output from said detection means falls within a second prescribed range, wherein said control means controls said elevating means so as to start lowering said seat when it is determined that said user has sat down as a result of a determination by said first determination means, and then said control means controls said elevating means so as to go on lowering said seat when it is determined that sitting condition of said user is stable as a result of a determination by said second determination means, and so as to decrease a speed of lowering said seat or stops lowering said seat when it is determined that sitting condition of said user is unstable as a result of determination by said second determination means.

* * * * *

UNITED STATES PATENT AND TRADEMARK OFFICE

CERTIFICATE OF CORRECTION

PATENT NO. : 6,745,417 B2
DATED : June 8, 2004
INVENTOR(S) : Sumino

It is certified that error appears in the above-identified patent and that said Letters Patent is hereby corrected as shown below:

Column 16,
Line 7, after "determining" insert -- that sitting --.

Signed and Sealed this

Seventh Day of September, 2004

JON W. DUDAS
*Director of the United States Patent and Trademark Office*